United States Patent [19]

Sato

[11] 4,033,762

[45] July 5, 1977

[54] METHOD FOR PREVENTING OXIDATION OF MELTED METAL

[76] Inventor: Kozo Sato, No. 7-12, Minami 3-chome, Yamamato-cho, Yao, Osaka, Japan

[22] Filed: June 3, 1976

[21] Appl. No.: 692,578

[52] U.S. Cl. ..... 75/96; 75/58; 75/93 A

[51] Int. Cl.[2] ..... C22B 9/00

[58] Field of Search ..... 75/53, 58, 93, 96

[56] References Cited

UNITED STATES PATENTS

| | | | |
|---|---|---|---|
| 1,970,136 | 8/1934 | Gummert | 75/96 |
| 2,297,447 | 9/1942 | Albrecht | 75/96 |
| 3,885,956 | 5/1975 | Obst | 75/58 |

*Primary Examiner*—Peter D. Rosenberg
*Attorney, Agent, or Firm*—Wenderoth, Lind & Ponack

[57] ABSTRACT

A method for preventing oxidation of melted metal at its surface. This method comprises the preparation of fine globules of a heat-resistant inorganic material divided into three groups differing in diameter from each other, said globules being coated with soft metal films so that they may come in closer contact with each other. The foregoing globules are deposited on the melted metal suitably so as to intercept the contact between the melted metal and the atmosphere.

5 Claims, 2 Drawing Figures

METHOD FOR PREVENTING OXIDATION OF MELTED METAL

This invention relates to an improved method for preventing melted metal from oxidizing by contact with the atmosphere at its surface.

Various methods have been attempted conventionally to intercept the contact between the melted metal and the atmosphere for attaining the above-mentioned purpose, but none of them has proven satisfactory yet. There is a method of placing, for example, a thick layer of oil or fat on the surface of melted metal, but this results in wasteful loss of the material by way of its evaporation, dissolution, carbonization, etc. Also, an unpleasant odor is caused therefrom which is an additional defect. Or, in other case wherein inorganic material such as lime or graphite is used in a powdery state, said material is likely to disperse under a thermal effect and accordingly result in environmental pollution that may cause respiratory disease especially among involved workers.

As manifested above, this invention has for its main object to provide a method for preventing oxidation of melted metal, especially of lead, zinc and tin, at its surface which is advantageously available for the melted metal bath related industries.

Specifically, this invention has discarded the problematic dispersing of the inorganic material, which may be more advantageous than the organic material otherwise used for this purpose, by way of transforming it into a mass of fine globules divided into three groups differing in diameter from each other, as numerically referred to hereinafter.

Taking into consideration the importance of thermal resistance required of the material used in this invention, the above-mentioned globules are prepared by admixing glass, diatom and aluminum oxide all in a powdery state, and further a surface activator and a binder at mixing ratios of 40, 20, 35, 1 and 4%, respectively.

The above-mentioned admixture is kneaded for about one hour with water being applied thereto in an amount equaling 50% of the total amount of the admixture. As a result, said admixture turns out to be a pasty plastic material having a strong adhesiveness. This mass is put through an extruding machine thereby being cut by a suitable device into a mass of fine globules as described hereinbefore, the globules being divided in three size-varied groups measuring 0.5 mm, 0.2 mm and 0.05 mm in diameter, respectively.

These globules at their spherical surfaces, get a further treatment of a soft metal coating, such as aluminum, oxidized iron, etc. After being dried, these globules are mixed so as to comprise the size-varied groups in an amount equivalent to each other.

The oxidation preventive agent thus-produced may be deposited so as to form a layer, preferably 3 cm – 5 cm thick, on the melted metal surface whereby the melted metal may be perfectly prevented from oxidation at its surface.

This invention is further manifested in the accompanying drawing illustrating an embodiment of this invention, in which.

Figure 1:
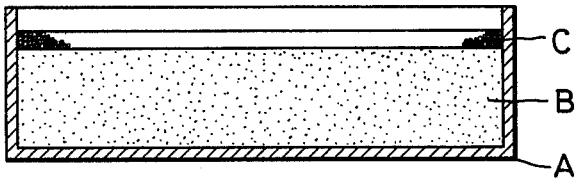
FIG. 1 shows a front elevation of a horizontally-longitudinal section of a melted metal bath applied with this invention method.

In the bath A, shown in FIG. 1, the melted metal B at its surface has a deposit, designated by C, of the above-mentioned oxidation preventive agent, the thickness of C preferably measuring 3 cm – 5 cm for perfectly intercepting the contact between the melted metal and the atmosphere.

Figure 2:
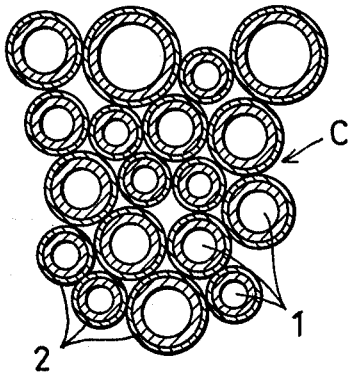
FIG. 2 shows sections of globules produced in this invention in an enlarged scale.

FIG. 2 manifests the state of metal films 2 helping globules 1 to make closer contact with each other and accordingly more effectively protect the melted metal surface from the atmosphere.

It may be self-explanatory in the foregoing description that the globules 1 may never be caused to disperse under thermal effect. Thus, this invention is an ideal method for preventing melted metal from oxidizing by contact with the atmosphere at its surface in a bath. It thereby contributes to the industries concerned to a great extent both economically and from the viewpoint of the worker's welfare.

What I claim is:

1. A method for preventing the oxidation of molten metal in a bath comprising the steps of (1) preparing a granular composition consisting of a mixture of relatively coarse, medium and fine globules ranging from about 0.5 mm to about 0.05 mm in size, whereby said coarse, medium and fine globules are present in substantially equal amounts, each of said globules consisting of a core made up of powdered glass, diatom and aluminum oxide coated with a material selected from the group consisting of aluminum and iron oxides and (2) depositing said composition on the molten metal to form partitioning layers thereover to separate the molten metal from the atmosphere.

2. A method according to claim 1, wherein the coarse globules have a diameter of 0.5 mm, the medium dize globules have a diameter of 0.2 mm and the fine globules have a diameter of 0.5 mm.

3. A method according to claim 2, wherein the core of said globules is made up of 40% glass, 20% diatom and 35% aluminum oxide.

4. A method according to claim 3, wherein 1% of a surface active agent and 4% of a binder are also present in the core of the globules.

5. A method according to claim 4, wherein said partitioning layer over the molten metal has a thickness of 3cm–5cm.

* * * * *

UNITED STATES PATENT OFFICE

CERTIFICATE OF CORRECTION

Patent No. 4,033,762 Dated July 5,1977

Inventor(s) Kozo Sato

It is certified that error appears in the above-identified patent and that said Letters Patent are hereby corrected as shown below:

Claim 2, line 2, change "dize" to -- size --;

line 4, change "0.5 mm" to -- 0.05 mm --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*